US006800367B2

(12) United States Patent
Hanyon et al.

(10) Patent No.: US 6,800,367 B2
(45) **Date of Patent: *Oct. 5, 2004**

(54) FIRE RETARDANT AND HEAT RESISTANT YARNS AND FABRICS INCORPORATING METALLIC OR OTHER HIGH STRENGTH FILAMENTS

(75) Inventors: William J. Hanyon, Salt Lake City, UT (US); Michael R. Chapman, Bountiful, UT (US)

(73) Assignee: Chapman Thermal Products, Inc., Salt Lake City, UT (US)

( * ) Notice: Subject to any disclaimer, the term of this patent is extended or adjusted under 35 U.S.C. 154(b) by 106 days.

This patent is subject to a terminal disclaimer.

(21) Appl. No.: 10/132,616

(22) Filed: Apr. 25, 2002

(65) Prior Publication Data

US 2004/0091705 A1 May 13, 2004

(51) Int. Cl.[7] ..... D02G 3/00; D02G 3/02

(52) U.S. Cl. ..... 428/364; 428/377; 428/379; 428/394; 428/373; 57/243; 57/244

(58) Field of Search ..... 428/359, 364, 428/377, 394, 373, 362, 367, 379; 57/243, 244, 210; 84/8, 7

(56) References Cited

U.S. PATENT DOCUMENTS

| | | | |
|---|---|---|---|
| 3,948,295 | A | 4/1976 | Lemont et al. |
| 4,004,295 | A | 1/1977 | Byrnes, Sr. |
| 4,031,188 | A | 6/1977 | Kohler |
| 4,081,498 | A | 3/1978 | Maranci |
| 4,331,729 | A | 5/1982 | Weber |
| 4,365,655 | A | 12/1982 | Feinberg |
| 4,384,449 | A | 5/1983 | Byrnes, Sr. et al. |
| 4,470,251 | A | 9/1984 | Bettcher |
| 4,776,160 | A | 10/1988 | Rees |
| 4,865,906 | A | 9/1989 | Smith, Jr. |
| 4,878,343 | A | 11/1989 | Weidenhaupt et al. |
| 4,902,561 | A | 2/1990 | McCullough, Jr. et al. |
| 4,912,781 | A | 4/1990 | Robins et al. |
| 4,987,664 | A | 1/1991 | McCullough, Jr. et al. |
| 5,015,522 | A | 5/1991 | McCullough, Jr. et al. |
| 5,023,953 | A | 6/1991 | Bettcher |
| 5,146,628 | A | 9/1992 | Herrmann et al. |
| 5,188,896 | A | 2/1993 | Suh et al. |

(List continued on next page.)

OTHER PUBLICATIONS

FAA News, "*FAA Tests Show New Materials Double Fuselage Burnthrough Times*", www.dot.gov, 2 pgs., May 5, 2000.

Orcon, "*Curlon Product Family, the Curlon™ Story*", www.orcon.com, 2 pgs., May 5, 2000.

Tortora, Phyllis G. and Collier, Billie J., "*Understanding Textiles*", Fifth Edition, Chapter 15, pp. 219–252.

*Primary Examiner*—Cynthia M. Kelly
*Assistant Examiner*—J. M. Gray
(74) *Attorney, Agent, or Firm*—Workman Nydegger

(57) ABSTRACT

Fire retardant and heat resistant yarns, fabrics, and other fibrous blends incorporate one or more fire retardant and heat resistant strands comprising oxidized polyacrylonitrile and one or more strengthening filaments such as metallic filaments (e.g., stainless steel), high strength ceramic filaments, or high strength polymer filaments. Such yarns, fabrics, and other fibrous blends have a superior tensile strength, cut resistance, abrasion resistance, LOI, TPP and continuous operating temperature compared to conventional fire retardant fabrics. The yarns, fabrics, and other fibrous blends are also more soft, supple, breathable and moisture absorbent and are therefore more comfortable to wear, compared to conventional fire retardant fabrics. The inventive yarns may be woven, knitted or otherwise assembled into a desired fabric or other article of manufacture.

51 Claims, 2 Drawing Sheets

U.S. PATENT DOCUMENTS

| | | | |
|---|---|---|---|
| 5,233,736 | A | 8/1993 | Hill |
| 5,275,858 | A | 1/1994 | Hock |
| 5,275,875 | A | 1/1994 | Suh et al. |
| 5,353,781 | A | 10/1994 | Calvillo |
| 5,356,707 | A | 10/1994 | McCullough, Jr. et al. |
| 5,496,625 | A | 3/1996 | Lilani |
| 5,506,043 | A | 4/1996 | Lilani |
| 5,582,912 | A | 12/1996 | McCullough, Jr. et al. |
| 5,632,137 | A | 5/1997 | Kolmes et al. |
| 5,688,577 | A | 11/1997 | Smith et al. |
| 5,806,295 | A | 9/1998 | Robins et al. |
| 5,965,223 | A | 10/1999 | Andrews et al. |
| 6,016,648 | A | 1/2000 | Bettcher et al. |
| 6,021,523 | A | 2/2000 | Vero |
| 6,033,779 | A | 3/2000 | Andrews |
| 6,155,084 | A | 12/2000 | Andrews et al. |
| 6,161,400 | A | 12/2000 | Hummel |
| 6,210,771 | B1 | 4/2001 | Post et al. |
| 6,260,344 | B1 | 7/2001 | Chakravarti |
| 6,266,951 | B1 | 7/2001 | Chakravarti |
| 6,279,305 | B1 | 8/2001 | Hummel |
| 6,287,686 | B1 | 9/2001 | Huang et al. |
| 6,289,702 | B1 | 9/2001 | Heirbaut et al. |
| 6,358,608 | B1 | 3/2002 | Hanyon et al. |

FIRE RETARDANT AND HEAT RESISTANT YARNS AND FABRICS INCORPORATING METALLIC OR OTHER HIGH STRENGTH FILAMENTS

BACKGROUND OF THE INVENTION

1. The Field of the Invention

The present invention is in the field of fire retardant and heat resistant yarns and fabrics, and other fibrous blends. More particularly, the present invention is in the field of yarns or fabrics that include metallic and/or other high strength filaments, oxidized polyacrylonitrile fibers and, optionally, one or more strengthening fibers.

2. The Relevant Technology

Fire retardant clothing is widely used to protect persons who are exposed to fire, particularly suddenly occurring and fast burning conflagrations. These include persons in diverse fields, such as race car drivers, military personnel and fire fighters, each of which may be exposed to deadly fires and extremely dangerous incendiary conditions without notice. For such persons, the primary line of defense against severe burns and even death is the protective clothing worn over some or all of the body.

Even though fire retardant clothing presently exists, such clothing is not always adequate to compensate for the risk of severe burns, or even death. Due to the limitations in flame retardance and heat resistance of present state of the art of flame retardant fabrics, numerous layers are typically worn, often comprising different fibrous compositions to impart a variety of different properties for each layer.

In view of the foregoing, there has been a long-felt need to find improved yarns, fabrics and other fibrous blends having better fire-retardant properties, higher heat resistance, lower heat transference, improved durability when exposed to constant heat or bursts of high heat, together with adequate strength and abrasion resistance, improved softness, better breatheability, improved moisture regain, increased flexibility and comfort, and other performance criteria. Examples of improved yarns, fabrics and other fibrous blends are disclosed in U.S. Pat. Nos. 6,287,686 and 6,358,608 to Huang et al., and U.S. Pat. No. 4,865,906 to Smith, Jr.

Even though the Huang et al. and Smith patents disclose fire retardant yarns, fabrics and other blends having a high Limiting Oxygen Index ("LOI") and Thermal Protective Performance ("TPP"), additional strength and cut resistance may be necessary for certain applications, such as in the manufacture of gloves, clothing and other articles of manufacture that require high tensile strength, cut resistance and durability. Thus, it would be a further advancement in the art to provide yarns, fabrics and other heat resistant, fire retardant blends such as those disclosed in Huang et al., but which had greatly increased tensile strength, cut resistance, and even higher abrasion resistance and durability.

Such fire retardant yarns, fabrics, and other fibrous blends are disclosed and claimed herein.

SUMMARY OF THE INVENTION

The present invention encompasses novel yarns, fabrics, and other fibrous blends having high fire retardance, heat resistance, tensile strength, cut resistance, and durability. The yarns, fabrics, and other fibrous blends within the scope of the present invention include one or more fire retardant and heat resistant strands in combination with one or more high strength or strengthening filaments (e.g. metallic filaments). In a preferred embodiment, the heat resistant and fire retardant strands will comprise a significant concentration of oxidized polyacrylonitrile (e.g., oxidized polyacrylonitrile fibers and/or filaments), either alone or in combination with one or more strengthening fibers. Preferred strengthening filaments are made from stainless steel.

The high strength and cut resistant fire retardant and heat resistant yarns of the invention can be woven, knitted, or otherwise assembled into an appropriate fabric that can be used to make a wide variety of articles of manufacture. Examples include, but not limited to, clothing, jump suits, gloves, socks, welding bibs, fire blankets, floor boards, padding, protective head gear, linings, cargo holds, mattress insulation, drapes, insulating fire walls, and the like.

In addition to having greatly increased fire retardant and heat resistant properties, as well as tensile strength, cut resistance and high durability, the fabrics manufactured according to the present invention are typically much softer and flexible, and have a more comfortable feel, compared to the industry standard fire retardant fabrics. They also are more breathable and have superior water regain compared to the leading fire retardant and heat resistant fabrics presently on the market.

The yarns, fabrics and other fibrous blends according to the invention combine the tremendous fire retardant and heat resistant characteristics of oxidized polyacrylonitrile (either alone or in combination with strengthening fibers) with relatively high strength filaments to provide materials high in tensile strength, cut resistance other desirable properties. In a preferred embodiment, oxidized polyacrylonitrile fibers are advantageously carded or otherwise formed into one or more threads, which are twisted or otherwise combined with one or more metallic filaments to form high strength, cut resistant, abrasion resistant, heat resistant, and fire retardant yarns. The metallic filaments include, but are not limited to, stainless steel, stainless steel alloys, other steel alloys, titanium, aluminum, copper, and other metals or metallic blends. In addition to, or instead of, metallic filaments, other strengthening filaments can be used, such as high strength ceramic filaments (e.g., based on silicon carbide, graphite, silica, aluminum oxide, other metal oxides, and the like), and high strength polymeric filaments (e.g., p-aramides, m-aramides, nylon, and the like). Fiberglass can also be used, although it is typically blended with other strengthening filaments or fibers in order for the final yarn to have adequate strength.

The heat resistant and fire retardant strands, in addition to including oxidized polyacrylonitrile, may advantageously include one or more strengthening fibers in order to increase the tensile strength, abrasion resistance and durability of the strands compared to heat resistant and fire retardant strands made solely of oxidized polyacrylonitrile. "Strengthening fibers" include, but are not limited to, polybenzimidazole (PBI), polyphenylene-2,6-benzobisoxazole (PBO), modacrilic, p-aramid, m-aramid, polyvinyl halides, wool, fire resistant polyesters, fire resistant nylons, fire resistant rayons, cotton, and melamine fibers. In addition to adding abrasion resistance and other strengthening properties, many strengthening fibers (e.g. PBI, PBO, modacrilic, p-aramid, m-aramid, fire resistant polyesters, fire resistant nylons, and fire resistant rayons) can also impart fire retardance and heat resistance.

Oxidized polyacrylonitrile fibers and the strengthening fibers may be carded separately into respective unblended threads that are later twisted or spun together to form a mixed strand, or they can be carded together to form a blended thread. One or more fire retardant and heat resistant strands or threads are then intertwined or otherwise joined together with one or more high strength filaments to form a yarn of increased strength, cut resistant and durability compared to yarns that do not include such filaments.

In general, the quantity of strengthening filaments relative to the fire retardant and heat resistant threads can be adjusted in order to tailor the resulting yarn to have a desired tensile strength, cut resistance, and durability for a desired application. Thus, even yarns containing high concentration of oxidized polyacrylonitrile fibers that are generally too weak to be used in the manufacture of fire retardant and heat resistant fabrics are greatly strengthened with a small percentage of one or more metallic filaments, and fabrics manufactured therefrom have been found to be surprisingly strong.

In general, it is preferable for the inventive yarns according to the invention to include strengthening filaments in an amount in a range from about 2% to about 80% by volume of the yarn. More preferably, the inventive yarns will include strengthening filaments in an amount in a range from about 5% to about 50% by volume of the yarn, and most preferably in a range from about 10% to about 40% by volume of the yarn.

The inventive yarns will preferably include fire retardant and heat resistant strands in an amount in a range from about 20% to about 98% by volume of the yarn, more preferably in a range from about 50% to about 95% by volume of the yarn, and most preferably in a range from about 60% to about 90% by volume of the yarn.

As stated above, the fire retardant and heat resistant strands used to form the inventive yarns, fabrics or other fibrous blends according to the invention may consist solely of oxidized polyacrylonitrile (i.e., essentially 100% by weight of such fire retardant and heat resistant strands) or they may include a blend of oxidized polyacrylonitrile and one or more strengthening fibers to provide additional strength and abrasion resistance to the resulting mixed threads. When a blend of materials is used to make fire retardant and heat resistant threads, it is preferable for the threads to include oxidized polyacrylonitrile in an amount in a range from about 5% to about 99% by weight of the thread, more preferably in a range from about 40% to about 97% by weight, and most preferably in range from about 60% to about 95% by weight of the thread.

Similarly, when the fire retardant and heat resistant strands used to form the inventive yarns include strengthening fibers in addition to oxidized polyacrylonitrile fibers, the strengthening fibers are preferably included in an amount in a range from about 1% to about 95% by weight of the fire retardant and heat resistant threads, more preferably in a range from about 3% to about 60% by weight, and most preferably in an amount in a range from about 5% to about 40% by weight of the threads.

By optimizing the quantity of oxidized polyacrylonitrile relative to the quantity of the strengthening filaments and, optionally, strengthening fibers, it is possible to obtain yarns, fabrics, and other fibrous blends that possess superior fire retardant properties, higher heat resistance, lower heat transference, and improved durability when exposed to constant heat or bursts of high heat, together with adequate strength and abrasion resistance, improved softness, better breatheability, improved moisture regain, increased flexibility and comfort, and other performance criteria compared to conventional fire retardant fabrics presently available in the market.

The fire retardant and heat resistant strands and strengthening filaments can be joined together to form a yarn using any yarn-forming methods known in the art. For example, one or more strengthening filaments, being less fire retardant and heat resistant, may comprise the core, while one or more fire retardant and heat resistant strands can be wrapped or wound around the filament core. Alternatively, the fire retardant and heat resistant strands and strengthening filaments can be braided or twisted together as desired.

These and other features of the present invention will become more fully apparent from the following description and appended claims, or may be learned by the practice of the invention as set forth hereinafter.

BRIEF DESCRIPTION OF THE DRAWINGS

Various embodiments of the present invention will now be discussed with reference to the appended drawings. It is appreciated that these drawings depict only typical embodiments of the invention and are therefore not to be considered limiting of its scope.

DETAILED DESCRIPTION OF THE PREFERRED EMBODIMENTS

I. Introduction

Figure 1:
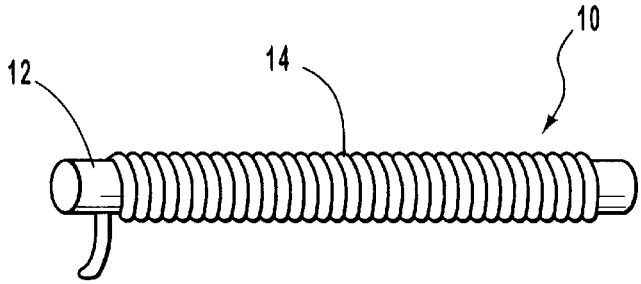
FIG. 1 illustrates a yarn construction and the manner in which the strands are wound according to one embodiment of the present invention depicting a filament core having a strand wrapped or wound thereon.

The present invention relates to novel fire retardant and heat resistant yarns, fabrics, and other fibrous blends. The yarns, fabrics, and other fibrous blends according to the invention include one or more fire retardant and heat resistant strands comprising oxidized polyacrylonitrile and one or more strengthening filaments (e.g., stainless steel filaments). The oxidized polyacrylonitrile imparts high fire retardance and heat resistance, and the strengthening filaments impart high strength and cut resistance. The fire retardant and heat resistant strands may comprise strengthening fibers in addition to oxidized polyacrylonitrile for increased strength and abrasion resistance.

The inventive yarns can be woven, knitted, or otherwise assembled into appropriate fabrics used to make a wide variety of fire retardant and heat resistant articles of manufacture such as clothing, jump suits, gloves, socks, welding bibs, fire blankets, floor boards, padding, protective head gear, linings, cargo holds, mattress insulation, drapes, insulating fire walls, and the like.

In general, the properties often considered desirable by persons who are exposed to fire and heat and who wear fire retardant fabrics include a high continuous operating temperature, high LOI, high TTP, low heat conductivity, maintenance of tensile strength and abrasion resistance over the life of the garment, particularly during and after exposure to high temperature, chemical resistance, softness, water regain and comfort. The fabrics manufactured according to the present invention are superior in most, if not all, of the foregoing properties.

II. Definitions

In general, heat degrades fibers and fabrics at different rates depending on fiber chemistry, the level of oxygen in the surrounding atmosphere of the fire, and the intensity of fire and heat. There are a number of different tests used to determine a fabric's flame retardance and heat resistance rating, including the Limiting Oxygen Index, continuous operating temperature, and Thermal Protective Performance.

The term "Limiting Oxygen Index" (or "LOI") is defined as the minimum concentration of oxygen necessary to support combustion of a particular material. The LOI is primarily a measurement of flame retardancy rather than temperature resistance. Temperature resistance is typically measured as the "continuous operating temperature".

The term "continuous operating temperature" measures the maximum temperature, or temperature range, at which a particular fabric will maintain its strength and integrity over time when exposed to constant heat of a given temperature or range. For instance, a fabric that has a continuous operating temperature of 400° F. can be exposed to temperatures of up to 400° F. for prolonged periods of time without significant degradation of fiber strength, fabric integrity, and protection of the user. In some cases, a fabric having a continuous operating temperature of 400° F. may be exposed to brief periods of heat at higher temperatures without significant degradation. The presently accepted standard for continuous operating temperature in the auto racing industry rates fabrics as being "flame retardant" if they have a continuous operating temperature of between 375° F. to 600° F.

The term "fire retardant" refers to a fabric, felt, yarn or strand that is self extinguishing. The term "nonflammable" refers to a fabric, felt, yarn or strand that will not burn.

The term "Thermal Protective Performance" (or "TPP") relates to a fabric's ability to provide continuous and reliable protection to a person's skin beneath a fabric when the fabric is exposed to a direct flame or radiant heat. The TPP measurement, which is derived from a complex mathematical formula, is often converted into an SFI rating, which is an approximation of the time it takes before a standard quantity of heat causes a second degree burn to occur.

The term "SFI Rating" is a measurement of the length of time it takes for someone wearing a specific fabric to suffer a second degree burn when the fabric is exposed to a standard temperature. The SFI Rating is printed on a driver's suit. The SFI Rating is not only dependent on the number of fabric layers in the garment, but also on the LOI, continuous operating temperature and TPP of the fabric or fabrics from which a garment is manufactured. The standard SFI Ratings are as follows:

| SFI Rating | Time to Second Degree Burn |
|---|---|
| 3.2A/1 | 3 Seconds |
| 3.2A/3 | 7 Seconds |
| 3.2A/5 | 10 Seconds |
| 3.2A/10 | 19 Seconds |

-continued

| SFI Rating | Time to Second Degree Burn |
|---|---|
| 3.2A/15 | 30 Seconds |
| 3.2A/20 | 40 Seconds |

A secondary test for flame retardance is the after-flame test, which measures the length of time it takes for a flame retardant fabric to self extinguish after a direct flame that envelopes the fabric is removed. The term "after-flame time" is the measurement of the time it takes for a fabric to self extinguish. According to SFI standards, a fabric must self extinguish in 2.0 seconds or less in order to pass and be certifiably "flame retardant".

The term "tensile strength" refers to the maximum amount of stress that can be applied to a material before rupture or failure. The "tear strength" is the amount of force required to tear a fabric. In general, the tensile strength of a fabric relates to how easily the fabric will tear or rip. The tensile strength may also relate to the ability of the fabric to avoid becoming permanently stretched or deformed. The tensile and tear strengths of a fabric should be high enough so as to prevent ripping, tearing, or permanent deformation of the garment in a manner that would significantly compromise the intended level of thermal protection of the garment.

The term "abrasion resistance" refers to the tendency of a fabric to resist fraying and thinning during normal wear. Although related to tensile strength, abrasion resistance also relates to other measurements of yarn strength, such as shear strength and modulus of elasticity, as well as the tightness and type of the weave or knit.

The term "cut resistance" refers to the tendency of yarn or fabrics to resist being severed when exposed to a shearing force.

The terms "fiber" and "fibers", as used in the specification and appended claims, refers to any slender, elongated structure that can be carded or otherwise formed into a thread. Fibers are characterized as being no longer than 25 mm. Examples include "staple fibers", a term that is well-known in the textile art. The term "fiber" differs from the term "filament", which is defined separately below and which comprises a different component of the inventive yarns.

The term "thread", as used in the specification and appended claims, shall refer to continuous or discontinuous elongated strands formed by carding or otherwise joining together one or more different kinds of fibers. The term "thread" differs from the term "filament", which is defined separately below and which comprises a different component of the inventive yarns.

The term "filament", as used in the specification and appended claims, shall refer to a single, continuous or discontinuous elongated strand formed from one or more metals, ceramics, polymers or other materials and that has no discrete sub-structures (such as individual fibers that make up a "thread" as defined above). "Filaments" can be formed by extrusion, molding, melt-spinning, film cutting, or other known filament-forming processes. A "filament" differs from a "thread" in that a filament is, in essence, one continuous fiber or strand rather than a plurality of fibers that have been carded or otherwise joined together to form a thread. "Filaments" are characterized as strands that are longer than 25 mm, and may be as long as the entire length of yarn (i.e. a monofilament).

"Threads" and "filaments" are both examples of "strands".

The term "yarn", as used in the specification and appended claims, refers to a structure comprising a plurality of strands. The inventive yarns according to the invention comprise at least one high-strength filament and at least one heat resistant and flame retardant strand that have been twisted, spun or otherwise joined together to form the yarn. This allows each component strand to impart its unique properties along the entire length of the yarn.

The term "fabric", as used in the specification and appended claims, shall refer to one or more different types of yarns that have been woven, knitted, or otherwise assembled into a desired protective layer.

When measuring the yarn, both volume and weight measurement may be applicable. Generally, volumetric measurements will typically be used when measuring the concentrations of the various components of the entire yarn, including threads and filaments, whereas weight measurements will typically be used when measuring the concentrations of one or more staple fibers within the thread or strand portion of the yarn.

III. Fire Retardant and Hear Resistant Yarns, Fabrics and Other Fibrous Blends

The yarns, fabrics and other fibrous blends according to the present invention combine the tremendous fire retardant and heat resistant characteristics of oxidized polyacrylonitrile with the strength and cut resistance of high strength filaments (e.g., metallic filaments). The present invention also contemplates combining with oxidized polyacrylonitrile the strengthening and abrasion resistance offered by one or more additional fibers which are typically much stronger, but less fire retardant and heat resistant, compared to oxidized polyacrylonitrile. These additional fibers may be referred to as "strengthening fibers". The yarns may include other components as desired to import other desired properties.

The yarns according to the invention may be manufactured using virtually any yarn-forming process known in the art. However, the yarns are preferably manufactured by cotton spinning or stretch broken spinning.

A. Strengthening Filaments

An important aspect of the invention is the incorporation of strengthening filaments within the yarns, fabrics and other fibrous blends of the invention. A "filament" is typically a continuous strand of a fused or otherwise substantially continuous material. In this way, a "filament" differs from a "thread", which is a strand formed from a large number of discontinuous and discreet fibers. Filaments typically have higher strength than threads as a result of their comprising a continuous strand of a relatively high strength material (e.g., metals, polymers or ceramics).

In general, metallic filaments are preferred because they have the highest combination of tensile strength and cut resistance. As a result, a given quantity of metallic filaments by volume of the yarn will typically yield yarns having higher strength and cut resistance compared to an equivalent volume of other types of high strength filaments. Metallic filaments may comprise any metallic filament known in the art. In general, preferred metallic filaments include those which are noncorrosive and high in tensile strength. Examples of metals used to form high strength filaments include, but are not limited to, stainless steel, stainless steel alloys, other steel alloys, titanium, aluminum, copper, and other metals or metallic blends. Stainless steel filaments are currently the most preferred filaments used to make yarns, fabrics and other fibrous blends according to the invention.

In addition to, or instead of, metallic filaments, other strengthening filaments can be used, such as high strength ceramic filaments (e.g., based on silicon carbide, graphite, silica, aluminum oxide, other metal oxides, and the like), and high strength polymeric filaments (e.g., p-aramides, m-aramides, nylon, and the like). Example of a high strength and heat resistant ceramic filaments are set forth in U.S. Pat. Nos. 5,569,629 and 5,585,312 to TenEyck et al., which disclose ceramic filaments that include 62–85% by weight $SiO_2$, 5–20% by weight $Al_2O_3$, 5–15% by weight MgO, 0.5–5% by weight $TiO_x$, and 0–5% $ZrO_2$. High strength and flexible ceramic filaments based on a blend of one or oxides of Al, Zr, Ti, Si, Fe, Co, Ca, Nb, Pb, Mg, Sr, Cu, Bi and Mn are disclosed in U.S. Pat. No. 5,605,870 to Strom-Olsen et al. For purposes of disclosing high strength ceramic filaments, the foregoing patents are incorporated herein by reference. Fiberglass filaments can also be used, although they are typically blended with other strengthening filaments or fibers in order for the final yarns to have adequate strength.

In general, the quantity of strengthening filaments relative to the fire retardant and heat resistant strands can be adjusted in order to tailor the resulting yarn to have a desired tensile strength, cut resistance, and durability for a desired application.

Preferably, strengthening filaments are elongated strands of metal, ceramic or polymer having a small enough diameter so that the filament is flexible enough for use in manufacturing yarns, fabrics or other fibrous blends. Strengthening filaments will preferably have a diameter in a range of about 0.0001" to about 0.01", more preferably in a range of about 0.0005" to about 0.008", and most preferably in a range of about 0.001" to about 0.006". Yarns containing a high concentration of oxidized polyacrylonitrile fibers that are generally too weak to be used in the manufacture of fire retardant and heat resistant fabrics can be greatly strengthened with even small percentages of one or more metallic filaments, and fabrics manufactured therefrom have been found to be surprisingly strong.

In general, where it is desired to maximize the strength of the material, it will be preferable to maximize the volume of strengthening filaments that are added to the yarn. However, it will be appreciated that as the amount of strengthening filaments increases in the yarn, the fire retardance and heat resistance generally declines. As a practical matter, the fire retardant and heat resistant requirements of the resulting yarn, fabric or other fibrous blend will determine the maximum amount of strengthening filaments that are added to the yarn.

In general, it is preferable for the inventive yarns according to the invention to strengthening filaments in an amount in a range from about 2% to about 80% by volume of the yarn. More preferably, the inventive yarns will include strengthening filaments in an amount in a range from about 5% to about 50% by volume, and most preferably in a range from about 10% to about 40% by volume of the yarn. It will be appreciated that the amount of strengthening filaments in the yarn may vary depending upon the particular application and whether strengthening fibers are used to manufacture fire retardant and heat resistant threads that are blended with the high strength filaments.

B. Fire Retardant and Heat Resistant Strands

Another important aspect of the invention, in addition to the use of strengthening filaments, is the incorporation of fire retardant and heat resistant strands that include oxidized polyacrylonitrile. In this way, the inventive yarns and articles of manufacture made therefrom derive high strength and cut resistance from the strengthening filaments, while also benefiting from the fire retardant and heat resistant properties afforded by the oxidized polyacrylonitrile-containing strands. The result is a unique synergy that yields articles of manufacture that are applicable for a large number of applications.

The fire retardant and heat resistant strands may comprise one or more filaments or threads comprising oxidized polyacrylonitrile, optionally in combination with one or more strengthening materials (e.g., one or more strengthening fibers added to a fire retardant and heat resistant thread). For example, it is within the scope of the invention for the one or more fire retardant and heat resistant strands to include one or more filaments comprising oxidized polyacrylonitrile, either alone or in combination with one or more threads or filaments comprising other materials. Some filaments such as p-aramid and m-aramid are both strengthening and fire retardant and heat resistant to a certain degree.

Fire retardant and heat resistant threads may be carded or otherwise formed from oxidized polyacrylonitrile and/or one or more types of strengthening fibers. The one or more fire retardant and heat resistant strands may comprise one or more threads consisting entirely of oxidized polyacrylonitrile fibers and/or one or more threads comprising a blend of oxidized polyacrylonitrile fibers and one or more types of strengthening fibers.

In addition to the specific examples disclosed herein, examples of fire retardant and heat resistant strands that may be useful in connection with the manufacture of the inventive yarns, fabrics and other fibrous blends disclosed herein are disclosed in U.S. Pat. No. 4,865,906 to Smith, Jr. and U.S. Pat. Nos. 6,287,686 and 6,358,608 to Huang et al., all of which are presently assigned to Chapman Thermal Products, Inc. For purposes of disclosing fire retardant and heat resistant strands, as well as methods of manufacturing useful articles of manufacture therefrom, the foregoing patents are incorporated by reference.

In general, it is preferable for the fire retardant and heat resistant strands to be included in an amount in a range from about 20% to about 98% by volume of the yarn, more preferably in a range from about 50% to about 95% by volume, and most preferably in a range from about 60% to about 90% by volume of the yarn. It will be appreciated that the amount of such fire retardant and heat resistant strands in the yarn may vary depending upon the particular application and whether such strands also include strengthening fibers to increase the strength and abrasion resistance of the oxidized polyacrylonitrile.

1. Oxidized Polyacrylonitrile

The oxidized polyacrylonitrile fibers or filaments within the scope of the invention may comprise any type of oxidized polyacrylonitrile having high fire retardance and heat resistance. In a preferred embodiment, the oxidized polyacrylonitrile is obtained by heating polyacrylonitrile (e.g., polyacrylonitrile fibers and filaments) in a cooking process between about 180° C. to about 300° C. for at least about 120 minutes. This heating/oxidation process is where the polyacrylonitrile receives its initial carbonization. Preferred oxidized polyacrylonitrile fibers and filaments will have an LOI of about 50–65. In most cases, oxidized polyacrylonitrile made in this way may be considered to be nonflammable.

Examples of suitable oxidized polyacrylonitrile fibers include LASTAN, manufactured by Ashia Chemical in Japan, PYROMEX, manufactured by Toho Rayon in Japan, PANOX, manufactured by SGL, and PYRON, manufactured by Zoltek. It is also within the scope of the invention to utilize filaments that comprise oxidized polyacrylonitrile.

In general, it is believed that fabrics including a substantial amount of oxidized polyacrylonitrile fibers and/or filaments will resist burning, even when exposed to intense heat or flame exceeding 3000° F., because the oxidized polyacrylonitrile fibers carbonize and expand, thereby eliminating any oxygen content within the fabric necessary for combustion of the more readily combustible strengthening fibers. In this way, the oxidized polyacrylonitrile fibers or filaments provide a combustion shield that makes the less fire retardant substances in the yarn or fabric behave more like fire retardant substances.

In addition, other strengthening fibers may be added to impart additional strength to the oxidized polyacrylonitrile fibers within a yarn. It has been found, for example, that for every 1% by weight of p-aramid fibers that are blended with oxidized polyacrylonitrile fibers, the strength of the resulting yarn increases by about 10% (exclusive of the strengthening effect afforded by any high strength filaments).

In this way it is possible to achieve a surprising synergy of desired properties, such as high strength and improved softness and comfort, while maximizing the desired fire retardance and heat resistance properties. Whereas conventional fire retardant fabrics may have adequate, or even superior, initial strength when maintained at or below their continuous operating temperatures, the physical integrity of such fabrics can be quickly compromised when they are exposed to temperatures exceeding their continuous operating temperature. In essence, the extremely high initial strength of such fabrics is wasted and becomes irrelevant when such fabrics are subjected to the high temperature conditions against which the fabrics were intended to afford protection.

In contrast to conventional thinking, the inventors now recognize that it is far better to manufacture fabrics that may have lower initial strength, but which will reliably maintain their strength over time, even when exposed to conditions of fire and heat. Moreover, by relying on the fire retardance and heat resistance properties inherent in oxidized polyacrylonitrile fibers or filaments, rather than relying on the treatment of less fire retardant fabrics with fire retardant chemicals, the fabrics manufactured according to the present invention will retain most, if not all, of their fire retardant and heat resistant qualities over time. In this way, the user of a fire retardant and heat resistant garment manufactured according to the present invention will have the assurance that the garment will impart the intended high level of fire retardance and heat resistance over time, even after the garment has been repeatedly laundered, exposed to UV radiation (e.g. sun light), or splashed with solvents or other chemicals that might otherwise reduce the fire retardance of treated fabrics.

The fire retardant and heat resistant strands used to form the inventive yarns, fabrics or other fibrous blends according to the invention may consist solely of oxidized polyacrylonitrile (i.e., essentially 100% by weight of the fire retardant and heat resistant strands). Alternatively, such strands may include a blend of oxidized polyacrylonitrile and one or more strengthening materials to provide additional strength and abrasion resistance to the resulting strands. When a blend of oxidized polyacrylonitrile and strengthening fibers are used to form fire retardant and heat resistant threads, it is preferable for such threads to include oxidized polyacrylonitrile fibers in an amount in a range from about 5% to about 99% by weight of the thread, more preferably in a range from about 40% to about 95% by weight, and most preferably in range from about 60% to about 95% by weight of the thread.

One of ordinary skill in the art will appreciate that other fire retardant and heat resistant materials can be used in addition to, or in place of, oxidized polyacrylonitrile so long as they have fire retardant and heat resistant properties that are comparable to those of oxidized polyacrylonitrile. By way of example, polymers or other materials having an LOI of at least about 50 and/or which do not burn when exposed to heat or flame having a temperature of about 3000° F. could be used in addition to, or instead of, oxidized polyacrylonitrile.

2. Strengthening Fibers

Strengthening fibers that may be incorporated within the yarns of the present invention may comprise any fiber known in the art. In general, preferred strengthening fibers will be those that have a relatively high LOI and TPP compared to natural organic fibers such as cotton, although the use of such fibers is certainly within the scope of the invention. The strengthening fibers will preferably have an LOI greater than about 20.

Strengthening fibers according to the invention should not be confused with strengthening filaments that may be made from similar materials. The two are not the same and their relative concentrations are measured in different ways. "Strengthening fibers" are carded or otherwise formed into threads, either alone or in combination with other fibers (e.g., oxidized polyacrylonitrile fibers). In contrast, "strengthening filaments" (as this term is defined herein) do not contain discrete component fibers but are typically one continuous strand of material.

Strengthening fibers within the scope of the invention include, but are not limited to, polybenzimidazole (PBI), polyphenylene-2,6-benzobisoxazole (PBO), modacrilic, p-aramid, m-aramid, polyvinyl halides, wool, fire resistant polyesters, fire resistant nylons, fire resistant rayons, cotton, linen, and melamine. By way of comparison, the LOI's of selected fibers are as follows:

| | |
|---|---|
| PBI | 35–36 |
| Modacrylic | 28–32 |
| m-Aramid | 28–36 |
| p-Aramid | 27–36 |
| Wool | 23 |
| Polyester | 22–23 |
| Nylon | 22–23 |
| Rayon | 16–17 |
| Cotton | 16–17 |

Examples of p-aramids are KEVLAR, manufactured by DuPont, TWARON, manufactured by Twaron Products BB, and TECKNORA, manufactured by Teijin. Examples of m-aramids include NOMEX, manufactured by DuPont, CONEX, manufactured by Teijin, and P84, an m-aramid yarn with a multi-lobal cross-section made by a patented spinning method manufactured by Inspec Fiber. For this reason P84 has better fire retardance properties compared to NOMEX.

An example of a PBO is ZYLON, manufactured by Toyobo. An example of a melamine fiber is BASOFIL. An example of a fire retardant or treated cotton is PROBAN, manufactured by Westex, another is FIREWEAR.

Strengthening fibers may be incorporated in the yarns of the present invention in at least the following ways: (1) as one or more strengthening threads twisted, wrapped, braided or otherwise joined together with strands comprising oxidized polyacrylonitrile strands and strengthening filaments; or (2) in the form of one or more threads comprising said strengthening fibers and oxidized polyacrylonitrile fibers.

In general, where it is desired to maximize the flame retardance and heat resistance of the fabrics made therefrom, it may be advantageous to minimize the amount of strengthening fibers that are added to the yarn. For example, it may be useful to add just enough of the strengthening fibers so as to satisfy the strength and abrasion resistance requirements of a given application. Furthermore, it will be appreciated that the high strength filament will provide much tensile strength, thus reducing the amount of strengthening fiber required to provide tensile strength. Moreover, by maximizing the flame retardance and heat resistance of the fabrics made from the inventive yarns, whatever strength and abrasion resistance possessed by the fabrics initially will be more reliably maintained in the case where the fabric is exposed to intense flame or radiant heat. This better preserves the integrity and protective properties of the fabric when the need for strength, integrity and protection against fire and heat are most critical.

In short, strengthening fibers may be added to the inventive yarns in the form of strengthening fiber threads comprising one or more different types of strengthening fibers or a blended thread comprising oxidized polyacrylonitrile fibers and one or more different types of strengthening fibers. When used in combination with oxidized polyacrylonitrile fibers to form a fire retardant and heat resistant thread, the strengthening fibers are preferably included in an amount in a range from about 1% to about 95% by weight of the thread, more preferably in a range from about 3% to about 60% by weight, and most preferably in range from about 5% to about 40% by weight of the thread.

The foregoing ranges are understood as being generally applicable and preferable when manufacturing yarns that include a combination of oxidized polyacrylonitrile fibers and one or more strengthening fibers. By adjusting the quantity of oxidized polyacrylonitrile fibers relative to the quantity of the strengthening filaments and strengthening fibers, it is possible to obtain yarns and fabrics that possess superior fire retardant properties, higher heat resistance, lower heat transference, and improved durability when exposed to constant heat or bursts of high heat, together with adequate strength and abrasion resistance, improved softness, better breatheability, improved moisture regain, increased flexibility and comfort, and other performance criteria compared to conventional fire retardant fabrics presently available in the market.

C. Other Components

In addition to high strength filaments and fire retardant and heat resistant strands, it is certainly within the scope of the invention to add additional components to the yarns, fabrics and other fibrous blends according to the invention. These include other materials that may be added in order to provide additional properties, such as dyes, additives that are dye-receptive, sizing agents, flame retardant agent, and the like.

IV. Fire Retardant and Heat Resistant Yarns and Fabrics and Articles of Manufacture The inventive yarns manufactured according to the invention may be formed into a wide variety of different types of fabrics and articles of manufacture according to manufacturing procedures known in the art of textiles and garments. The yarns may be woven, knitted, layered, or otherwise assembled using any process known in the art to manufacture a wide variety of different fabrics. For example, a suitable knitting process if the Ne 20/1 knitting process. Articles of manufacture include, but are not limited to, clothing, jump suits, gloves, socks, blankets, protective head gear, linings, insulating fire walls, and the like.

In general, the fabrics or other articles of manufacture made according to the invention can be tailored to have specific properties and satisfy desired performance criteria. Some of the improved properties possessed by the yarns and fabrics of the present invention include, but are not limited to, high tensile strength, extremely high LOI, continuous operating temperature and TPP values, which are the standard measurements for fire retardance, heat resistance and thermal protection (or insulation ability), respectively, while also performing equally well or better in the other important performance criteria, such as softness, comfort, flexibility, breatheability and water regain.

As stated above, the maximum continuous operating temperature according to SFI standards is 600° F. However, certain fire retardant fabrics presently available in the market burn, begin to shrink while charring, then crack and decompose when exposed to a temperature of 600° F. This all occurs in about 10 seconds, which is hardly enough time for a person wearing such fabrics to safely remove himself or herself from the heat source before suffering burns, or at least without permanent damaging the fire retardant garment made from such fabrics. Under flammability testing, the leading fire retardant fabrics will ignite. They also have problems passing the shrinkage test.

When subjected to the same conditions as those described above, the preferred fabrics made according to the present invention are much more resistant to degradation by heat or flame. The preferred fabric even disperses or reflects the heat energy away from the fabric. The preferred fabric will not ignite or burn, even when exposed to temperatures exceeding 2600° F. for over 120 seconds. Moreover, the preferred fabric resists shrinkage. Each of the foregoing contributes to fabrics having an extremely high TPP compared to other known fire retardant fabrics presently available on the market.

A feature of the present invention is the use of yarns that include oxidized polyacrylonitrile, which is known to have extremely high fire retardance, heat resistance and insulation ability. However, oxidized polyacrylonitrile is known to be generally too weak to be used in manufacturing woven or knitted fabrics that will have even minimal strength and abrasion resistance. For this reason, pure oxidized polyacrylonitrile is mainly used in the manufacture of filters, insulating felts, or other articles where tensile strength and abrasion resistance are not important criteria. In the case of clothing to be worn over long periods of time by persons such as race car drivers, fire fighters and the like, it is important for the fire retardant fabric to be strong, durable, abrasion resistant and cut resistant in order to provide a reliable barrier to heat, fire and mechanical damage.

For this reason, oxidized polyacrylonitrile can be blended with high strength filaments and, optionally one or more strengthening fibers, in order to yield yarns and fabrics having adequate strength, durability, abrasion resistance and cut resistance for a wide variety of applications.

The yarns, fabrics and other blends according to the invention preferably have an LOI of at least about 40, more preferably greater than about 45, and most preferably greater than about 50. The yarns, fabrics and other blends preferably have a continuous operating temperature of at least about 750° F., more preferably at least about 1000° F., and most preferably at least about 1500° F.

In accordance with the present invention, there are various ways for forming yarns comprising one or more high strength filaments and one or more fire retardant and heat resistant strands. Any desired yarn-forming procedure and configuration may be used to form inventive yarns according to the invention. Reference is now made to the drawings, which depict non-limiting examples of strand and filament arrangements within the scope of the invention.

FIG. 1 depicts an embodiment of a yarn 10 comprising a single high strength filament 12 as the core and a single fire retardant and heat resistant strand 14 wound or wrapped around the filament core. This embodiment provides a high level of fire retardance and heat resistance because the high strength filament 12 (e.g., a metallic filament) is entirely encased by an outer sheath comprising a winding of the fire retardant and heat resistant strand 14.

It should be understood, however, that a modified yarn (not shown) similar to yarn 10 may comprise a core that includes multiple high strength filaments and/or an outer sheath that includes multiple fire retardant and heat resistant strands. Alternatively, the core may also include one or more fire retardant and heat resistant strands and/or one or more threads consisting of fibers other than oxidized polyacrylonitrile. The outer sheath may comprise one or more windings of high strength filaments, which may advantageously be encased by one or more additional windings comprising one or more fire retardant and heat resistant strands.

In addition, it will be appreciated that the reverse configuration may also be employed, in which one or more fire retardant and heat resistant strands constitute the core, while one or more high strength filaments are wrapped around the core.

Figure 2:
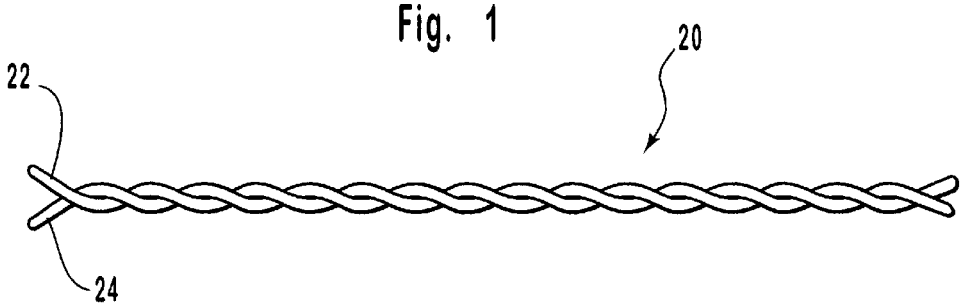
FIG. 2 illustrates another embodiment of the yarn construction of the present invention depicting two strands spirally wound.

FIG. 2 depicts a yarn 20 in which a single high strength filament 22 and a single fire retardant and heat resistant strand 24 are wound in a spiral helix. This embodiment would not be expected to provide the same level of fire retardance and heat resistance as the embodiment of FIG. 1. However, this embodiment may be used to reduce the cost of the yarn-forming process while still providing an adequate level of fire retardance and heat resistance for some applications.

It will be appreciated that one or more fire retardant and heat resistant strands (not shown) can be wrapped around the spiral helix of FIG. 2 in order to provide greatly enhanced fire retardance and heat resistance. Alternatively, or in addition, one or more high strength filaments (not shown) can be wrapped around the spiral helix of FIG. 2 in order to provide greater strength and cut resistance.

Figure 3:
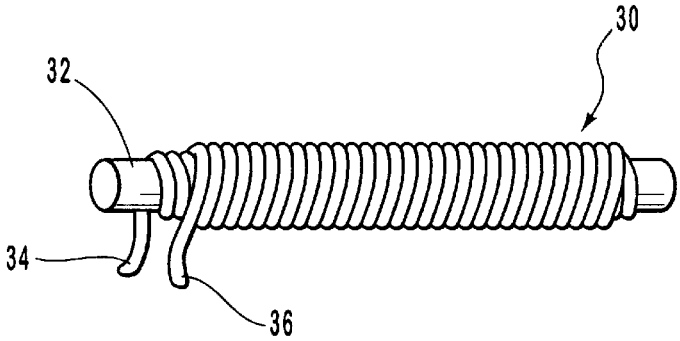
FIG. 3 illustrates yet another embodiment of the yarn construction of the present invention depicting a filament core having two strands wrapped or wound thereon, the strands being wound in opposite directions.

FIG. 3 depicts a yarn 30 comprising a high strength filament 32 as the core, a strengthening thread 34 comprising one or more strengthening fibers wrapped around the high strength filament as an intermediate protective layer, and a fire retardant and heat resistant strand 36 as an outer protective layer. The strengthening thread 34 may comprise oxidized polyacrylonitrile fibers in addition to the one or more strengthening fibers. The fire retardant and heat resistant strand 36 may comprise a filament consisting of oxidized polyacrylonitrile or a thread consisting of oxidized polyacrylonitrile fibers or comprising a blend of oxidized polyacrylonitrile fibers and one or more strengthening fibers.

As depicted in FIG. 3, when multiple strands are wrapped around an inner core, each strand is advantageously wound in a direction opposite an adjacent strand. In an alternative embodiment, the strengthening thread 32 may constitute the core, with the high strength filament 32 and the fire retardant and heat resistant strand 36 being wound around the strengthening thread 32 core.

Figure 4:
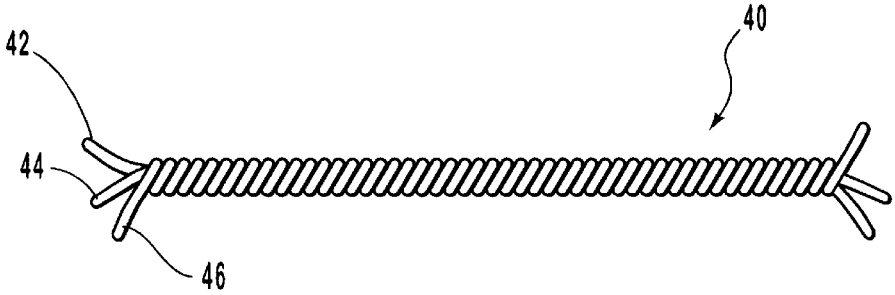
FIG. 4 illustrates still another embodiment of the yarn construction of the present invention depicting three strands spirally wound.

FIG. 4 depicts a yarn 40 comprising a high strength filament 42, a first fire retardant and heat resistant strand 44, and a second fire retardant and heat resistant strand 46 spirally wound together. This arrangement is a variation of the arrangement of FIG. 2 and provides increased fire retardance and heat resistance because increasing the number of fire retardant and heat resistant strands (i) increases the probability of that the high strength filament 42 is embedded behind the fire retardant and heat resistant strands at a given location along the yarn and (ii) because the relative concentration of fire retardant and heat resistant material within the yarn increases relative to the concentration of the high strength filament material.

Figure 5:
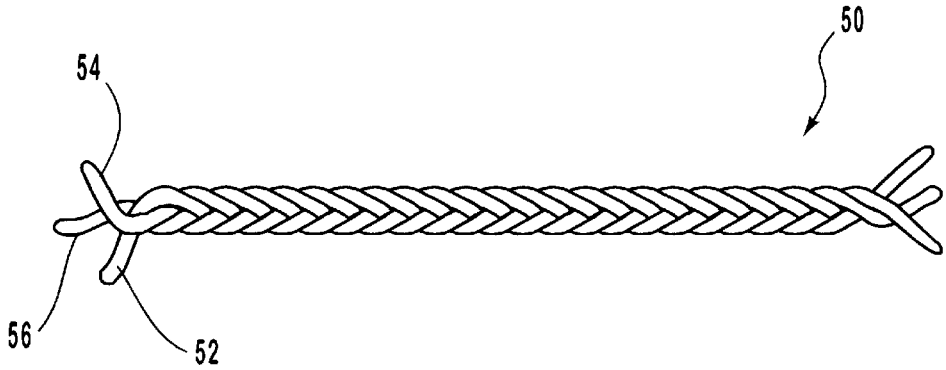
FIG. 5 illustrates another embodiment of the yarn construction of the present invention depicting three braided strands.

FIG. 5 depicts a yarn 50 comprising a high strength filament 52, a first fire retardant and heat resistant strand 54, and a second fire retardant and heat resistant strand 56 braided together.

Figure 6:
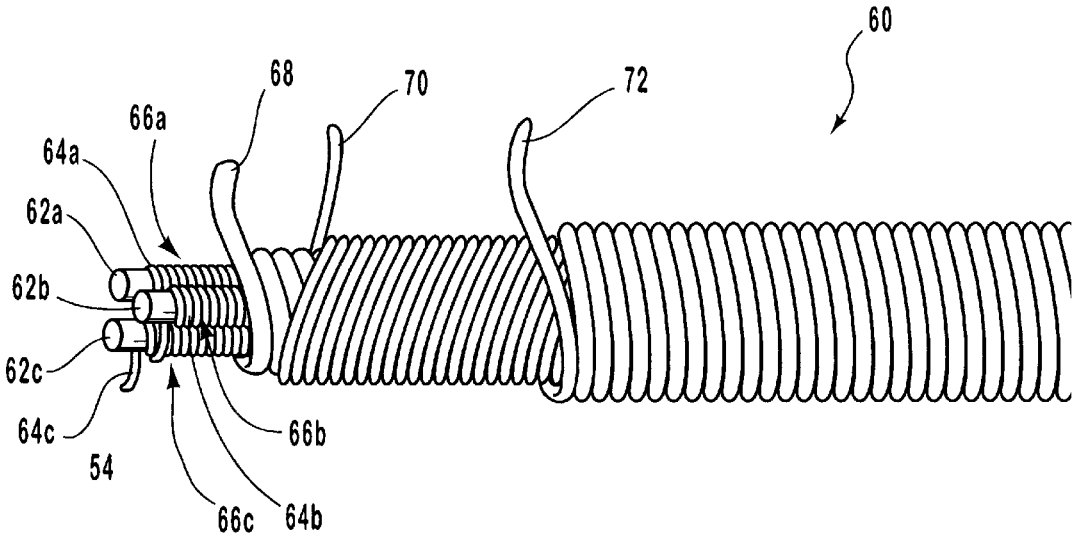
FIG. 6 illustrates another embodiment of the yarn construction of the present invention depicting multiple cores and multiple strands wound or wrapped thereon.

FIG. 6 depicts a yarn 60 comprising multiple cores and multiple outer windings. In order to provide maximum strength and cut resistance together with maximum fire retardance and heat resistance, the yarn 60 comprises high strength filaments 62A–C wrapped with strengthening threads 64A–C, respectively, to yield high strength blended core strands 66A–C. The blended core strands 66A–C comprise a core bundle.

An inner fire retardant and heat resistant strand 68 is wound around the core bundle comprising the blended core strands 66A–C. An intermediate strengthening thread 70 is wound around the inner strand 68, and an outer fire retardant and heat resistant strand 72 is wound around the intermediate strengthening thread 70 to complete the yarn 60. Strand 68, thread 70 and strand 72 comprise the outer windings or protective layer.

Notwithstanding the foregoing, it will be appreciated that the filaments, threads and strands comprising the core strands, core bundle and outer windings can be rearranged as desired to yield a desired combination of materials. For example, one or more high strength filaments may comprise at least a portion of the outer windings. Similarly, one or more fire retardant and heat resistant strands may comprise at least a portion of the core bundle. The strengthening thread(s) may comprise one or more strengthening fibers and, optionally, oxidized polyacrylonitrile fibers. The fire retardant and heat resistant strand(s) may comprise an oxidized polyacrylonitrile filament or thread, or a thread comprising a blend of oxidized polyacrylonitrile fibers and one or more strengthening fibers.

In view of the foregoing, it should be readily apparent that the yarns according to the invention may have any desired configuration and blend of components to yield a yarn having the desired level of strength, abrasion resistance, cut resistance, fire retardance and heat resistance. One of ordinary skill in the art, with the present specification as guide, will be able to develop a desired yarn having optimum (or at least adequate) properties for a given application.

Exemplary arrangements of high strength filaments and other strands, as well as methods for manufacturing yarns and useful articles of manufacture, are disclosed in U.S. Pat. No. 4,912,781 to Robins et al., U.S. Pat. No. 5,146,628 to Herrmann et al., U.S. Pat. No. 4,470,251 to Bettcher, U.S. Pat. No. 4,384,449 to Byrnes, Sr. et al., U.S. Pat. No. 4,004,295 to Byrnes, Sr., U.S. Pat. No. 5,632,137 to Holmes et al., U.S. Pat. No. 5,806,295 to Robins et al., U.S. Pat. No. 6,016,648 to Bettcher et al., U.S. Pat. No. 6,033,779 to Andrews, U.S. Pat. No. 6,155,084 to Andrews et al., U.S. Pat. No. 6,161,400 to Hummel and U.S. Pat. No. 6,260,344 to Chakravarti. For purposes of disclosing methods for manufacturing yarns from a plurality of strands of varying materials, as well as fabrics and other useful articles of manufacture from a plurality of yarns or strands, but not with respect to specific materials used to make yarns, fabrics and other useful articles of manufacture, the foregoing patents are incorporated herein by reference.

It will be readily appreciated that fabrics having high fire retardance, heat resistance, and cut resistance can be manufactured using a blend of different yarns that are woven, knitted or otherwise joined together to form a desired fabric. For example, two or more yarns having varying concentrations of strengthening filaments and fire retardant and heat resistant strands so as to yield two or more yarns having varying levels of fire retardance, heat resistance, and cut resistance may be blended together within a single fabric in order to engineer a fabric having desired properties.

Moreover, fabrics having high fire retardance, heat resistance, and cut resistance can be manufactured using a blend of different yarns in which one of the yarns contains one or more strengthening filaments but no oxidized polyacrylonitrile and another of the yarns contains at least one fire retardant and heat resistant strand comprising oxidized polyacrylonitrile, preferably at least one thread comprising a blend of oxidized polyacrylonitrile fibers and at least one type of strengthening fibers. It is therefore possible for one of the yarns comprising one or more strengthening filaments (e.g., metallic filaments) but no oxidized polyacrylonitrile to provide high strength and cut resistance to the fabric but less fire retardance and heat resistance, while another one of the yarns comprising oxidized polyacrylonitrile but no strengthening filaments provides high fire retardance and heat resistance but less strength and cut resistance. Due to the close and intimate proximity of the different yarns, a fabric can be constructed that overall exhibits excellent fire retardance, heat resistance, and cut resistance (i.e., the benefits are cumulative and the deficiencies are offset).

By way of example but not limitation, a fabric may be manufactured from (1) a first yarn comprising one or more metallic filaments (e.g., one or more stainless steel filaments) and one or more threads or strands comprising one or more staple fibers (e.g., one or more strengthening fibers) or a polymeric filament (e.g., p-aramid, m-aramid or nylon) that does not include any oxidized polyacrylonitrile and (2) a second yarn comprising one or more strands that include oxidized polyacrylonitrile (e.g., threads or filaments of pure oxidized polyacrylonitrile or threads comprising oxidized polyacrylonitrile fibers and one or more strengthening fibers) but which does not include any metallic filaments. In this way the metallic filaments are able to impart greatly increased strength and cut resistance to the fabric by way of the first yarn while the oxidized polyacrylonitrile is able to impart greatly increase fire retardance and heat resistance by way of the second yarn.

V. Examples of the Preferred Embodiments

The following examples are presented in order to more specifically teach the methods of forming yarns, fabrics and other fibrous blends according to the invention. The examples include metallic filaments, oxidized polyacrylonitrile strands and threads made of oxidized polyacrylonitrile and strengthening fibers. They are used in conjunction with different manufacturing processes in order to create the yarns and fabrics of the present invention.

Those examples that are written in the past tense are actual working examples that have been carried out. Those examples that are written in the present tense are to be considered hypothetical or "prophetic" examples, although they are based on, or have been derived from, actual yarns, fabrics and other fibrous blends that have been manufactured and tested.

Example 1

A core was formed from two 20 gauge strands consisting of Kevlar fibers. A 0.002" stainless steel filament was wrapped around the Kevlar core to form an intermediate structure. Two 18 gauge fire retardant and heat resistant threads of CarbonsX® were wrapped around the intermediate structure to form the yarn. Each thread of CarbonX® consisted of an 86/14 blend of oxidized polyacrylonitrile fibers and Kevlar fibers measured as weight percent of the CarbonX® threads. The resulting yarn comprised 43.6% by volume of the CarbonX® threads, 12.8% by volume of the stainless steel filament, and 43.6% by volume of the Kevlar threads.

Example 2

A core was formed from two 20 gauge strands consisting of Kevlar fibers and one stainless steel filament having a diameter of 0.002". A 0.002" stainless steel filament was wrapped around the core to form an intermediate structure. Two 18 gauge threads of CarbonX® were wrapped around the intermediate structure to form the yarn. Each thread of CarbonX® consisted of an 86/14 blend of oxidized polyacrylonitrile fibers and Kevlar fibers measured as weight percent of the CarbonX® threads. The resulting yarn comprised 42.9% by volume of the CarbonX® threads, 10.7% by volume of the stainless steel filament in the core, 9.8% by volume of the stainless steel filament around the core, and 36.6% by volume of the Kevlar threads in the core.

Example 3

A core was formed from two 18 gauge strands threads of CarbonX® and one stainless steel filament having a diameter of 0.003". Two 18 gauge threads of CarbonX® were wrapped around the core to form the yarn. Each thread of CarbonX® consisted of an 86/14 blend of oxidized polyacrylonitrile fibers and Kevlar fibers measured as weight percent of the CarbonX® threads. The resulting yarn comprised 38.8% by volume of the CarbonX® threads wrapped around the core, 23.7% by volume of the stainless steel filament in the core, and 38.1% by volume of the CarbonX threads in the core.

Example 4

A core was formed from two 18 gauge strands threads of CarbonX® wrapped with one stainless steel filament having a diameter of 0.003". Two 18 gauge threads of CarbonX® were wrapped around the core to form an intermediate structure. Two 18 gauge threads of CarbonX® were wrapped around the intermediate structure to form the yarn. Each thread of CarbonX® consisted of an 86/14 blend of oxidized polyacrylonitrile fibers and Kevlar fibers measured as weight percent of the CarbonX® threads. The resulting yarn comprised 26.2% by volume of the CarbonX® threads in the core, 16.8% by volume of the stainless steel filament in the core, 25.7% by volume of the CarbonX® threads wrapped around the core to form the intermediate structure, and 31.3% by volume of the CarbonX® threads wrapped around the intermediate structure.

VI. Summary

From the foregoing, the invention provides improved fire retardant and heat resistant yarns, fabrics, and other fibrous blends which have exceptional fire retardant properties and are high in tensile strength. The invention further provides improved fibrous blends that yield fire and flame retardant yarns, fabrics, and other fibrous blends that are able to satisfy a wider range of performance criteria compared to conventional fire retardant fabrics and other fibrous blends.

The invention also provides fire retardant yarns, fabrics, and other fibrous blends that have higher continuous operating temperatures, higher LOI and TPP ratings, and improved resistance to heat transfer, while having adequate strength, including tensile strength and abrasion resistance, as well as a softer, more flexible and comfortable feel when worn against a person's skin compared to conventional fire retardant fabrics and other fibrous blends.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A heat and cut resistant yarn comprising:

at least one fire retardant and heat resistant strand that comprises oxidized polyacrylonitrile; and at least one strengthening filament comprising at least one of silicon carbide, graphite, or a high strength ceramic that includes at least one oxide of Al, Zr, Ti, Si, Fe, Co, Ca, Nb, Pb, Mg, Sr, Cu, Bi, or Mn, wherein the at least one fire retardant and heat resistant strand and the at least one strengthening filament are combined in a manner so that the heat resistant yarn has increased strength compared to a yarn consisting exclusively of the at least one fire retardant and heat resistant strand.

2. A heat and cut resistant yarn as defined in claim 1, wherein the at least one fire retardant and heat resistant strand comprises at least one filament consisting essentially of oxidized polyacrylonitrile.

3. A heat and cut resistant yarn as defined in claim 1, wherein the at least one fire retardant and heat resistant strand comprises at least one thread that includes oxidized polyacrylonitrile fibers.

4. A heat and cut resistant yarn as defined in claim 3, wherein the at least one thread comprising oxidized polyacrylonitrile fibers further includes at least one strengthening fiber.

5. A heat and cut resistant yarn as defined in claim 4, wherein the at least one strengthening fiber comprises at least one of polybenzimidazole, polyphenylene-2,6-benzobisoxazole, modacrilic, p-aramid, m-aramid, a polyvinyl halide, wool, fire resistant polyester, nylon, rayon, cotton, or melamine.

6. A heat and cut resistant yarn as defined in claim 4, wherein the at least one fire retardant and heat resistant thread includes oxidized polyacrylonitrile fibers in an amount in a range of about 5% to about 99% by weight of the thread.

7. A heat and cut resistant yarn as defined in claim 4, wherein the at least one fire retardant and heat resistant thread includes oxidized polyacrylonitrile fibers in an amount in a range of about 40% to about 97% by weight of the thread.

8. A heat and cut resistant yarn as defined in claim 4, wherein the at least one fire retardant and heat resistant thread includes oxidized polyacrylonitrile fibers in an amount in a range of about 60% to about 95% by weight of the thread.

9. A heat and cut resistant yarn as defined in claim 4, wherein the at least one fire retardant and heat resistant thread includes strengthening fibers in an amount in a range of about 1% to about 95% by weight of the thread.

10. A heat and cut resistant yarn as defined in claim 4, wherein the at least one fire retardant and heat resistant thread includes strengthening fibers in an amount in a range of about 3% to about 60% by weight of the thread.

11. A heat and cut resistant yarn as defined in claim 4, wherein the at least one fire retardant and heat resistant thread includes strengthening fibers in an amount in a range of about 5% to about 40% by weight of the thread.

12. A heat and cut resistant yarn as defined in claim 1, wherein the yarn includes at least one thread or filament comprising at least one of polybenzimidazole, polyphenylene-2,6-benzobisoxazole, modacrilic, p-aramid, m-aramid, a polyvinyl halide, wool, fire resistant polyester, nylon, rayon, cotton, or melamine fibers.

13. A heat and cut resistant yarn as defined in claim 1, wherein the at least one fire retardant and heat resistant strand is included in an amount in a range of about 20% to about 98% by volume of the yarn.

14. A heat and cut resistant yarn as defined in claim 1, wherein the at least one fire retardant and heat resistant strand is included in an amount in a range of about 50% to about 95% by volume of the yarn.

15. A heat and cut resistant yarn as defined in claim 1, wherein the at least one fire retardant and heat resistant strand is included in an amount in a range of about 60% to about 90% by volume of the yarn.

16. A heat and cut resistant yarn as defined in claim 1, further comprising at least one additional strengthening filament that comprises at least one of steel, stainless steel, a steel alloy, titanium, a titanium alloy, aluminum, an aluminum alloy, copper, or a copper alloy.

17. A heat and cut resistant yarn as defined in claim 1, further comprising at least one additional strengthening filament that comprises at least one of p-aramide, m-aramides, or nylon.

18. A heat and cut resistant yarn as defined in claim 1, wherein the at least one strengthening filament is included in an amount in a range of about 2% to about 80% by volume of the yarn.

19. A heat and cut resistant yarn as defined in claim 1, wherein the at least one strengthening filament is included in an amount in a range of about 5% to about 50% by volume of the yarn.

20. A heat and cut resistant yarn as defined in claim 1, wherein the at least one strengthening filament is included in an amount in a range of about 10% to about 40% by volume of the yarn.

21. A heat and cut resistant yarn as defined in claim 1, wherein the at least one strengthening filament includes at least one continuous filament spanning substantially the entire length of the yarn.

22. A heat and cut resistant yarn as defined in claim 1, wherein the yarn comprises at least a portion of an article of manufacture selected from the group consisting of an article of clothing, a jump suit, a glove, a sock, a welding bib, a fire blanket, a floor board, padding, protective head gear, a lining, a cargo hold, mattress insulation, a drape, and an insulating fire wall.

23. A heat and cut resistant yarn as defined in claim 1, wherein the at least one fire retardant and heat resistant strand and the at least one strengthening filament are twisted together.

24. A heat and cut resistant yarn as defined in claim 1, wherein the yarn comprises at least three strands that are braided together.

25. A heat and cut resistant yarn as defined in claim 1, wherein the yarn comprises a core comprising at least one core strand and a protective layer surrounding the core comprising at least one outer strand.

26. A heat and cut resistant yarn as defined in claim 25, wherein the core comprises at least two core strands that are either substantially parallel or twisted together or at least three core strands that are braided together.

27. A heat and cut resistant yarn as defined in claim 25, wherein the core comprises at least two core strands, each of which is wrapped with at least one additional strand to form a blended core strand.

28. A heat and cut resistant yarn as defined in claim 25, wherein the protective layer surrounding the core comprises at least two outer strands that are wound in opposite directions relative to each other.

29. A heat and cut resistant yarn as defined in claim 25, wherein the at least one strengthening filament comprises at least a portion of the core and wherein the at least one fire retardant and heat resistant strand comprises at least a portion of the protective layer.

30. A heat and cut resistant yarn as defined in claim 29, wherein the yarn comprises at least two strengthening filaments, at least one of which comprises at least a portion of the core and at least one other of which comprises at least a portion of the protective layer.

31. A heat and cut resistant yarn as defined in claim 29, wherein the yarn comprises at least two fire retardant and heat resistant strands, at least one of which comprises at least a portion of the core and at least one other of which comprises at least a portion of the protective layer.

32. A heat and cut resistant yarn as defined in claim 1, wherein the yarn further comprises at least one fire retardant and heat resistant polymer in addition to oxidized polyacrylonitrile that has an LOI of at least about 50 and that does not burn when exposed to heat or flame having a temperature of about 30000 F.

33. A heat and cut resistant yarn comprising: at least one strengthening filament comprising at least one of silicon carbide, graphite, or a high strength ceramic that includes at least one oxide of Al, Zr, Ti, Si, Fe, Co, Ca, Nb, Pb, Mg, Sr, Cu, Bi, or Mn; and at least one fire retardant and heat resistant thread comprising:

oxidized polyacrylonitrile fibers, and at least one type of strengthening fibers blended with the oxidized polyacrylonitrile fibers, wherein the at least one fire retardant and heat resistant strand and the at least one strengthening filament are combined in a manner so that the heat resistant yarn has increased strength compared to a yarn consisting exclusively of the at least one fire retardant and heat resistant strand.

34. A heat and cut resistant yarn as defined in claim 33, further comprising at least one stainless steel filament.

35. A heat and cut resistant yarn as defined in claim 33, wherein the at least one type of strengthening fibers comprises at least one of polybenzimidazole, polyphenylene-2, 6-benzobisoxazole, modacrilic, p-aramid, m-aramid, polyvinyl halide, wool, polyester, nylon, rayon, cotton, or melamine.

36. A heat and cut resistant yarn as defined in claim 33, further comprising at least one of a low strength fiberglass, metallic or high strength polymer filament.

37. A heat and cut resistant yarn comprising:

at least one fire retardant and heat resistant strand that comprises a polymer that has an LOI of at least about 50 and that does not burn when exposed to heat or flame having a temperature of about 3000° F. and at least one of p-aramid or m-aramid; and at least one strengthening filament selected from the group consisting of metallic filaments, high strength ceramic filaments, and high strength polymer filaments, wherein the at least one fire retardant and heat resistant strand and the at least one strengthening filament are combined in a manner so that the heat resistant yarn has increased strength compared to a yarn consisting exclusively of the at least one fire retardant and heat resistant strand.

38. A heat and cut resistant yarn as defined in claim 37, wherein the at least one fire retardant and heat resistant strand comprises oxidized polyacrylonitrile.

39. A heat and cut resistant yarn as defined in claim 37, further comprising at least one low strength fiberglass filament.

40. A heat and cut resistant fabric comprising:

at least one high strength yarn comprising at least one strengthening filament selected from the group consisting of metallic filaments, high strength ceramic filaments, and high strength polymeric filaments and at least one additional strand that is combined with the at least one strengthening filament to form the at least one high strength yarn; and at least one fire retardant and heat resistant yarn comprising oxidized polyacrylonitrile, wherein the at least one high strength yarn and the at least one fire retardant and heat resistant yarn are woven, knitted or otherwise joined together to form the fabric having (i) greater fire retardance and heat resistance compared to a fabric formed exclusively of the at least one high strength yarn and (ii) greater strength and cut resistance compared to a fabric formed exclusively of the at least one fire retardant and heat resistant yarn.

41. A heat and cut resistant yarn as defined in claim 40, wherein the at least one strengthening filament within the at least one strengthening yarn comprises at least one of steel, stainless steel, a steel alloy, titanium, a titanium alloy, aluminum, an aluminum alloy, copper, or a copper alloy.

42. A heat and cut resistant yarn as defined in claim 40, wherein the at least one additional strand within the at least one strengthening yarn comprises at least one of oxidized polyacrylonitrile, polybenzimidazole, polyphenylene-2,6-benzobisoxazOle, modacrilic, p-aramid, m-aramid, polyvinyl halide, wool, polyester, nylon, rayon, cotton, or melamine.

43. A heat and cut resistant yarn as defined in claim 40, wherein the at least one fire retardant and heat resistant yarn comprises at least one of a filament or thread consisting essentially of oxidized polyacrylonitrile.

44. A heat and cut resistant yarn as defined in claim 43, wherein the at least one fire retardant and heat resistant yarn further comprises at least one thread comprising at least one type of strengthening fibers.

45. A heat and cut resistant yarn as defined in claim 40, wherein the at least one fire retardant and heat resistant yarn comprises at least one thread comprising oxidized polyacrylonitrile fibers and at least one type of strengthening fibers.

46. A heat and cut resistant yarn as defined in claim 40, further comprising at least one low strength fiberglass filament.

47. A heat and cut resistant fabric comprising:

at least one high strength yarn comprising at least one strengthening filament selected from the group consisting of metallic filaments, high strength ceramic filaments, and high strength polymeric filaments and at least one fire retardant and heat resistant strand that is combined with the at least one strengthening filament to form the at least one high strength yarn, wherein the at least one fire retardant and heat resistant strand comprises at least one of p-aramid, m-aramid, nylon, or a polymer that has an LOI of at least about 50 and that does not burn when exposed to heat or flame having a temperature of about 3000° F.; and at least one fire retardant and heat resistant yarn comprising at least one fire retardant and heat resistant polymer that has an LOI of at least about 50 and that does not burn when exposed to heat or flame having a temperature of about 3000° F., wherein the at least one high strength yarn and the at least one fire retardant and heat resistant yarn are woven, knitted or otherwise joined together to form the fabric having (i) greater fire retardance and heat resistance compared to a fabric formed exclusively of the at least one high strength yarn and (ii) greater strength and cut resistance compared to a fabric formed exclusively of the at least one fire retardant and heat resistant yarn.

48. A heat and cut resistant fabric as defined in claim 47, wherein the polymer that has a LOI of at least about 50 and that does not burn when exposed to heat or flame having a temperature of about 3000° F. comprises oxidized polyacrylonitrile.

49. A heat and cut resistant yarn comprising:

at least one fire retardant and heat resistant strand that includes oxidized polyacrylonitrile and at least one of p-aramid or m-aramid; and at least one strengthening filament selected from the group consisting of metallic filaments, high strength ceramic filaments, high strength polymer filaments, and fiberglass filaments, wherein the at least one fire retardant and heat resistant strand and the at least one strengthening filament are combined in a manner so that the heat resistant yarn has increased strength compared to a yarn consisting exclusively of the at least one fire retardant and heat resistant strand.

50. A heat and cut resistant yarn as defined in claim 49, wherein the at least one fire retardant and heat resistant strand comprises a thread formed from a blend comprising oxidized polyacrylonitrile fibers and at least one of p-aramid or m-aramid fibers.

51. A heat and cut resistant yarn as defined in claim 49, wherein the at least one fire retardant and heat resistant strand comprises at least one strand consisting essentially of oxidized polyacrylonitrile fibers or filaments and at least one other strand consisting essentially of p-aramid or m-aramid fibers or filaments.

* * * * *

UNITED STATES PATENT AND TRADEMARK OFFICE

CERTIFICATE OF CORRECTION

PATENT NO. : 6,800,367 B2 
DATED : October 5, 2004
INVENTOR(S) : William J. Hanyon and Michael R. Chapman It is certified that error appears in the above-identified patent and that said Letters Patent is hereby corrected as shown below:

Column 2,
Line 12, before "not limited to" insert -- are --
Line 30, after "resistance" insert -- and --

Column 3,
Line 5, change "resistant" to -- resistance, --
Line 11, after "containing" insert -- a --
Line 45, before "range from about 60%" insert -- a --

Column 6,
Line 40, change "refers" to -- refer --

Column 7,
Line 23, change "Hear" to -- Heat --

Column 8,
Line 6, change "Example" to -- "Examples --
Line 51, before "strengthening" insert -- contain --

Column 12,
Line 62, before "the Ne 20/1" change "if" to -- is --

Column 13,
Line 18, change "permanent" to -- permanently --

Column 15,
Line 1, after "probability" remove "of"

Column 16,
Line 44, change "increase" to -- increased --

Column 17,
Lines 27 and 40, after "18 gauge" remove "strands"

Column 20,
Line 31, change "30000 F." to -- 3000º F. --
Line 32, after "comprising:" begin a new indented paragraph

UNITED STATES PATENT AND TRADEMARK OFFICE

CERTIFICATE OF CORRECTION

PATENT NO. : 6,800,367 B2
DATED : October 5, 2004
INVENTOR(S) : William J. Hanyon and Michael R. Chapman It is certified that error appears in the above-identified patent and that said Letters Patent is hereby corrected as shown below:

Column 21,
Line 42, change "benzobisoxazOle" to -- benzobisoxazole --

Signed and Sealed this

Twenty-second Day of March, 2005

JON W. DUDAS
*Director of the United States Patent and Trademark Office*